US011762410B2

(12) United States Patent
Migliavacca

(10) Patent No.: US 11,762,410 B2
(45) Date of Patent: Sep. 19, 2023

(54) VOLTAGE REFERENCE WITH TEMPERATURE-SELECTIVE SECOND-ORDER TEMPERATURE COMPENSATION

(71) Applicant: SEMICONDUCTOR COMPONENTS INDUSTRIES, LLC, Phoenix, AZ (US)

(72) Inventor: Paolo Migliavacca, Mauzac (FR)

(73) Assignee: SEMICONDUCTOR COMPONENTS INDUSTRIES, LLC, Scottsdale, AZ (US)

( * ) Notice: Subject to any disclaimer, the term of this patent is extended or adjusted under 35 U.S.C. 154(b) by 82 days.

(21) Appl. No.: 17/304,769

(22) Filed: Jun. 25, 2021

(65) Prior Publication Data

US 2022/0413537 A1 Dec. 29, 2022

(51) Int. Cl.
*G05F 3/26* (2006.01)

(52) U.S. Cl.
CPC ..... *G05F 3/262* (2013.01)

(58) Field of Classification Search
CPC ..... G05F 3/02; G05F 3/08; G05F 3/24; G05F 3/245; G05F 3/242; G05F 3/26; G05F 3/262; G05F 3/265; G05F 3/267; G05F 3/30

See application file for complete search history.

(56) References Cited

U.S. PATENT DOCUMENTS 5,053,640 A 10/1991 Yum
5,767,664 A 6/1998 Price
5,973,550 A * 10/1999 Bowers ..... G05F 3/247 327/541

(Continued)

OTHER PUBLICATIONS

Randlisek, Zoltan; "Voltage Reference with Temperature Compensation"; U.S. Appl. No. 16/949,836, filed Nov. 17, 2020; Semiconductor Components Industries, LLC, Phoenix, AZ.

(Continued)

*Primary Examiner* — Thienvu V Tran
*Assistant Examiner* — Shahzeb K Ahmad
(74) *Attorney, Agent, or Firm* — Dickinson Wright PLLC; Jonathan A. Schnayer

(57) ABSTRACT

Methods, systems, and apparatuses for producing a compensated voltage reference. The method includes operating a voltage reference circuit. The method also includes activating a first compensation circuit when an operating temperature is less than or equal to a first temperature threshold. The first compensation circuit is configured to extract a first compensation current from the voltage reference circuit. The method further includes deactivating the first compensation circuit when the operating temperature is greater than the first temperature threshold. The method also includes activating a second compensation circuit when the operating temperature is greater than or equal to a second temperature threshold. The second compensation circuit is configured to extract a second compensation current from voltage reference circuit. The second temperature threshold is greater than the first temperature threshold. The method further includes deactivating the second compensation circuit when the operating temperature is less than the second temperature threshold.

20 Claims, 5 Drawing Sheets

(56) References Cited

U.S. PATENT DOCUMENTS

| | | | | |
|---|---|---|---|---|
| 6,642,699 | B1 * | 11/2003 | Gregoire, Jr. | G05F 3/30 323/907 |
| 7,728,575 | B1 * | 6/2010 | Ozalevli | G05F 3/30 327/513 |
| 8,575,912 | B1 * | 11/2013 | Tung | G05F 3/30 323/907 |
| 8,878,512 | B2 | 11/2014 | Kondo | |
| 8,907,652 | B2 | 12/2014 | Lecce et al. | |
| 9,910,452 | B2 | 3/2018 | Takada et al. | |
| 2007/0279029 | A1 * | 12/2007 | Cave | G05F 3/30 323/313 |
| 2010/0156384 | A1 * | 6/2010 | Ozalevli | G05F 3/30 323/313 |
| 2010/0181986 | A1 | 7/2010 | Cave | |
| 2012/0139523 | A1 | 6/2012 | Kondo | |
| 2012/0256605 | A1 | 10/2012 | Lecce et al. | |
| 2013/0328615 | A1 | 12/2013 | Sano et al. | |
| 2015/0002131 | A1 | 1/2015 | Takada et al. | |
| 2015/0177770 | A1 * | 6/2015 | Furusawa | G05F 3/30 323/313 |
| 2019/0317543 | A1 * | 10/2019 | Yoshida | G05F 1/468 |
| 2022/0050488 | A1 | 2/2022 | Randlisek et al. | |

OTHER PUBLICATIONS

Brokaw, A. Paul, "How to Make a Bandgap Voltage Reference in One Easy Lesson," Copyright 2011 A. Paul Brokaw and Integrated Device Technology, 60 pages.

Brokaw, A. Paul, "A Simple Three-Terminal IC Bandgap Reference," IEEE Journal of Solid-State Circuits, vol. SC-9, No. 6, Dec. 1974, pp. 388-393.

Zhu, Guangqian, et al., "A 4.6-ppm/° C. High-Order Curvature Compensated Bandgap Reference for BMIC", Transactions on Circuits and Systems II: Express Briefs, vol. 66, No. 9, Sep. 2019, pp. 1492-1496.

* cited by examiner

VOLTAGE REFERENCE WITH TEMPERATURE-SELECTIVE SECOND-ORDER TEMPERATURE COMPENSATION

BACKGROUND

Electronic circuits created on semiconductor substrates may use direct current (DC) reference voltages for a host of functions. For example, the DC reference voltage may be used in voltage regulators to control regulated voltage, may be used in voltage-controlled oscillators to control frequency of operation, and may be used in analog-to-digital converters as a reference for the conversion, to name a few.

However, for consistent operation of the circuits the DC reference voltage should be stable in spite of changing operational temperature of the circuit. A reference circuit may apply both first-order and second-order correction in an attempt to compensate for temperature variation. For example, related art voltage reference circuits use a pair of voltage-to-current converters to provide second-order correction at low and high operating temperatures.

The related-art compensation may be sufficient in many circuits. However, in high precision circuits, first-order and second-order compensation provided in related art voltage reference circuits may not be sufficient.

SUMMARY

The present disclosure provides a method for producing a compensated voltage reference. The method includes operating a voltage reference circuit. The voltage reference circuit includes a first transistor, a second transistor, and an amplifier. The first transistor is configured to drive a first reference current through a first current path. The second transistor is configured to drive a second reference current through a second current path. The amplifier is configured to produce a reference voltage based on a difference between currents present on the first current path and the second current path. The method also includes activating a first compensation circuit when an operating temperature is less than or equal to a first temperature threshold. The first compensation circuit is configured to extract a first compensation current from the first current path. The method further includes deactivating the first compensation circuit when the operating temperature is greater than the first temperature threshold. The method also includes activating a second compensation circuit when the operating temperature is greater than or equal to a second temperature threshold. The second compensation circuit is configured to extract a second compensation current from the first current path. The second temperature threshold is greater than the first temperature threshold. The method further includes deactivating the second compensation circuit when the operating temperature is less than the second temperature threshold.

The present disclosure also provides a system for producing a compensated voltage reference. The system includes, in one implementation, a voltage reference circuit and a compensation controller. The voltage reference circuit includes a first transistor, a second transistor, and an amplifier. The first transistor is configured to drive a first reference current through a first current path. The second transistor is configured to drive a second reference current through a second current path. The amplifier is configured to produce a reference voltage based on a difference between currents present on the first current path and the second current path. The compensation controller includes a first compensation circuit and a second compensation circuit. The first compensation circuit is configured to extract a first compensation current from the first current path. The second compensation circuit is configured to extract a second compensation current from the first current path. The compensation controller is configured to activate the first compensation circuit when an operating temperature is less than or equal to a first temperature threshold. The compensation controller is also configured to deactivate the first compensation circuit when the operating temperature is greater than the first temperature threshold. The compensation controller is further configure to activate the second compensation circuit when the operating temperature is greater than or equal to a second temperature threshold. The second temperature threshold is greater than the first temperature threshold. The compensation controller is further configured to deactivate the second compensation circuit when the operating temperature is less than the second temperature threshold.

The present disclosure further provides an apparatus for producing a compensated voltage reference. The apparatus includes means for driving a first reference current through a first current path. The apparatus also includes means for driving a second reference current through a second current path. The apparatus further includes means for producing a reference voltage based on a difference between currents present on the first current path and the second current path. The apparatus also includes means for extracting a first compensation current from the first current path. The apparatus further includes means for extracting a second compensation current from the first current path. The apparatus also includes means for activating the means for extracting the first compensation current when an operating temperature is less than or equal to a first temperature threshold. The apparatus further includes means for deactivating the means for extracting the first compensation current when the operating temperature is greater than the first temperature threshold. The apparatus also includes means for activating the means for extracting the second compensation current when the operating temperature is greater than or equal to a second temperature threshold. The second temperature is threshold is greater than the first temperature threshold. The apparatus further includes means for deactivating the means for extracting the second compensation current when the operating temperature is less than the second temperature threshold.

BRIEF DESCRIPTION OF THE DRAWINGS

For a detailed description of example implementations, reference will now be made to the accompanying drawings in which.

DEFINITIONS

Figure 1:
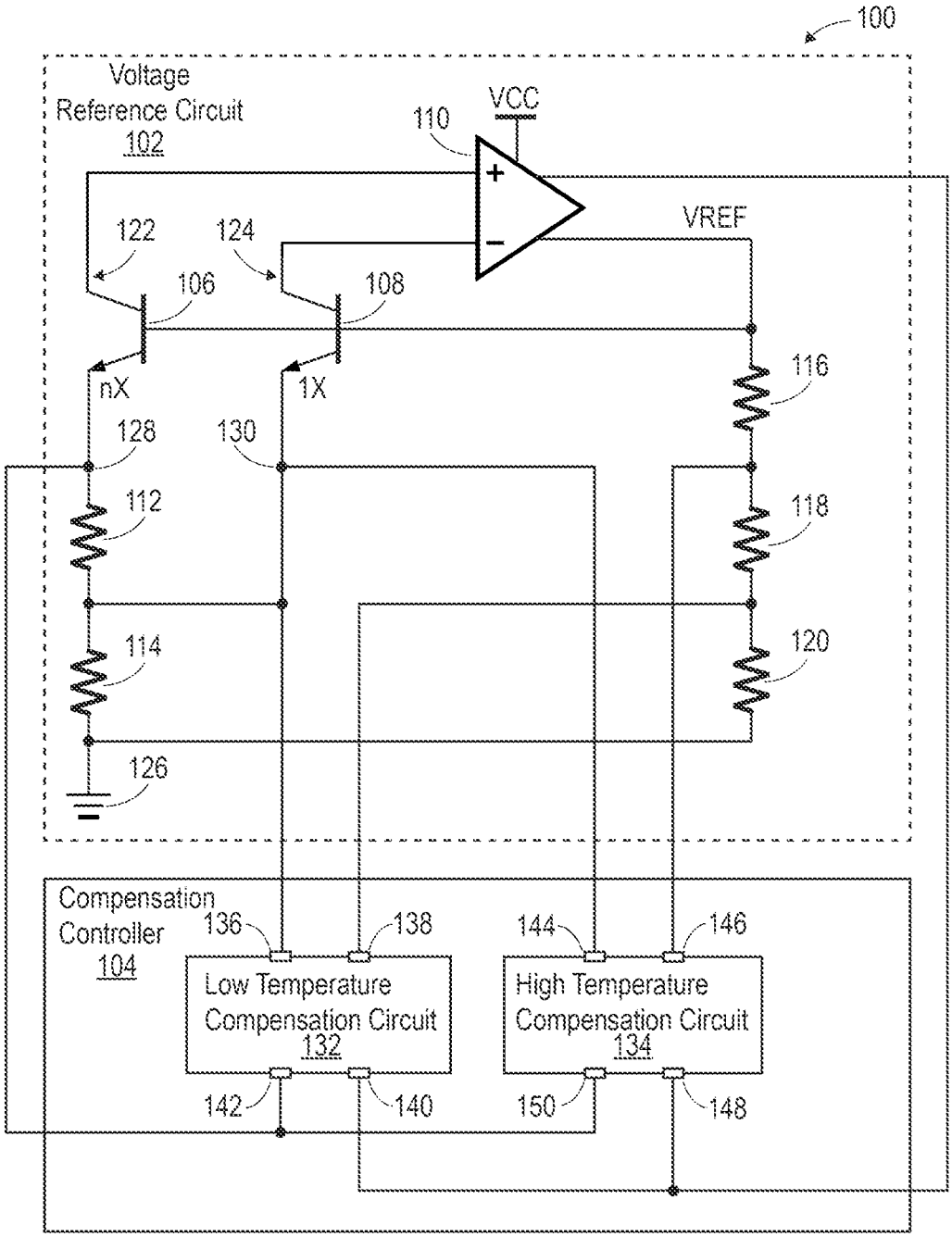
FIG. 1 is a schematic diagram of an example of a system for producing a compensated voltage reference in accordance with some implementations.

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other devices and connections.

In relation to electrical devices (whether stand alone or as part of an integrated circuit), the terms "input" and "output" refer to electrical connections to the electrical devices, and shall not be read as verbs requiring action. For example, a compensation controller may have a compensation output that defines an electrical connection to the compensation controller, but shall not be read to require outputting signals. The signal associated with a "compensation output" may be an outward flowing electrical current (e.g. a current driven outward) or inward flowing electrically current (e.g., sinking a current). As a further example, a differential amplifier (such as an operational amplifier) may have a first differential input and a second differential input, and these "inputs" define electrical connections to the operational amplifier, and shall not be read to require inputting signals to the operational amplifier.

"Assert" shall mean changing the state of a Boolean signal. Boolean signals may be asserted high or with a higher voltage, and Boolean signals may be asserted low or with a lower voltage, at the discretion of the circuit designer. Similarly, "de-assert" shall mean changing the state of the Boolean signal to a voltage level opposite the asserted state.

"Controller" shall mean, alone or in combination, individual circuit components, an application specific integrated circuit (ASIC), a microcontroller with controlling software, a reduced-instruction-set computing (RISC), a digital signal processor (DSP), process with controlling software, a processor with controlling software, a programmable logic device (PLD), or a field programmable gate array (FPGA), configured to read inputs and drive outputs responsive to the inputs.

DETAILED DESCRIPTION

The following discussion is directed to various implementations of the invention. Although one or more of these implementations may be preferred, the implementations disclosed should not be interpreted, or otherwise used, as limiting the scope of the present disclosure, including the claims. In addition, one skilled in the art will understand that the following description has broad application, and the discussion of any implementation is meant only to be exemplary of that implementation, and not intended to intimate that the scope of the present disclosure, including the claims, is limited to that implementation.

Various example implementations are directed to methods, systems, and apparatuses for producing or generating a reference voltage with precise temperature compensation. More particularly, at least some example implementations are directed to second-order temperature compensation applied within selective operating temperature ranges. More particularly still, at least some example implementations are directed to deactivating second-order temperature compensation at normal operating temperatures. The specification now turns to an example system to orient the reader.

FIG. 1 is a schematic diagram of an example of a system 100 for producing a compensated voltage reference in accordance with some implementations. The system 100 illustrated in FIG. 1 includes a voltage reference circuit 102 and a compensation controller 104. The voltage reference circuit 102 illustrated in FIG. 1 includes a pair of transistors (i.e., first transistor 106 and second transistor 108), an amplifier 110, and a plurality of resistors (i.e., first resistor 112, second resistor 114, third resistor 116, fourth resistor 118, and fifth resistor 120). The system 100 illustrated in FIG. 1 is provided as one example of such a system. The methods described herein may be used with systems having fewer, additional, or different components in different configurations than the system 100 illustrated in FIG. 1. For example, the first transistor 106 and the second transistor 108 are illustrated in FIG. 1 as bi-polar junction transistors (BJTs), and in particular, NPN-type BJTs. However, other types of BJTs may be used (e.g., PNP-type BJTs), and in fact other types of transistors may also be used (e.g., field effect transistors (FETs)). In some implementations, the voltage reference circuit 102 and the compensation controller 104 are separate components (as illustrated in FIG. 1). In alternate implementations, the voltage reference circuit 102 and the compensation controller 104 may be part of the same component. For example, the voltage reference circuit 102 and the compensation controller 104 may both be positioned on a single printed circuit board and/or within a single chip housing.

The first transistor 106 and the second transistor 108 are matched transistors in the sense they are doped the same and have the same current density (e.g., emitter current density) as a function of the current flow into and/or the voltage at their collectors. However, the first transistor 106 has a larger current flow area than the second transistor 108. If the second transistor 108 is said to have area X, then the first transistor 106 may have an integer multiple larger area (i.e., nX shown in FIG. 1). That is to say, the first transistor 106 and the second transistor 108 may have an area ratio (e.g., emitter area ratio) of 2:1 or more, in some cases 8:1, and in a particular case 256:1. The collector of the first transistor 106 is coupled to the non-inverting input of the amplifier 110. The output of the amplifier 110 is coupled to the base of the first transistor 106. The first transistor 106 is configured to drive a reference current through a first current path 122 that is coupled to a non-inverting input of the amplifier 110. The collector of the second transistor 108 is coupled to the inverting input of the amplifier 110. The output of the amplifier 110 is coupled to the base of the second transistor 108. The second transistor 108 is configured to drive a reference current through a second current path 124 that is coupled to an inverting input of the amplifier 110. The first resistor 112 is coupled between the emitter of the first transistor 106 and the emitter of the second transistor 108. The second resistor 114 is coupled between the emitter of the second transistor 108 and a reference terminal 126 (e.g., a ground terminal). The pair of the first resistor 112 and the second resistor 114 together form a voltage divider. The third resistor 116, the fourth resistor 118, and the fifth resistor 120 are coupled in a series configuration between the output of the amplifier 110 and the reference terminal 126.

In the absence of the compensation controller 104, the voltage reference circuit 102 may produce a reference voltage VREF that has first-order temperature compensation. The operational description is based on an analysis of the boundary conditions, starting with a situation where the currents in the first current path 122 and the second current path 124, are very low. In particular, when the currents in the first current path 122 and the second current path 124 are low, the voltages at a first node 128 and a second node 130 are about the same. However, because the first transistor 106 illustrated in FIG. 1 has a greater emitter area, more current flows through the first transistor 106 than flows through the second transistor 108. Stated slightly differently, for low current flow where the base-to-emitter voltages of the first transistor 106 and the second transistor 108 are about the same, more current flows through the first transistor 106 because of the great emitter area. When the first transistor 106 flows more current than the second transistor 108, it follows that the magnitude of the reference voltage VREF produced by the amplifier 110 increases.

Now consider the opposite situation, and still ignoring for now the compensation controller 104. In particular, when current flow is very large, the voltage at the first node 128 may be large, taking into account the combined resistances of the first resistor 112 and the second resistor 114. However, the second transistor 108 sees only the second resistor 114, and thus more current may flow through the second transistor 108 than flows through the first transistor 106 in spite of the difference in the emitter area ratio. When the second transistor 108 flows more current than the first transistor 106, it follows that the magnitude of the reference voltage VREF produced by the amplifier 110 decreases.

Between the two example boundary cases, and in steady-state operation, the amplifier 110 drives a reference voltage VREF such that the current of the first current path 122 matches the current of the second current path 124. Thus, the voltage reference circuit 102 illustrated in FIG. 1 represents a closed-loop control system that attempts to balance the currents flowing through the first transistor 106 and the second transistor 108 by making adjustments to the reference voltage VREF. In steady-state operation, the difference in base-to-emitter voltage as between the first transistor 106 and the second transistor 108 is proportional to operating temperature of the voltage reference circuit 102. The difference in base-to-emitter voltage as between the first transistor 106 and the second transistor 108 appears across the first resistor 112. In particular, in steady-state operation of the voltage reference circuit 102, the voltage across the first resistor 112 is directly proportional to operating temperature.

Moreover, the voltage at the second node 130 is proportional to operating temperature. The current flowing across the first resistor 112 is equal to the difference between the base-to-emitter voltages of the first transistor 106 and the second transistor 108 divided by the resistance of the first resistor 112. The current flowing through the second resistor 114 is double the current flowing through the first resistor 112 because the currents flowing through the collectors of the first transistor 106 and the second transistor 108 are equal to each other and the currents flowing through the emitters of the first transistor 106 and the second transistor 108 are equal to each other too, with only a small negligible difference. So, the voltage across the second resistor 114 is also directly proportional to operating temperature. The reference voltage produced by the amplifier 110 thus has first-order temperature compensation that takes into account the directly proportional nature of the difference in base-to-emitter voltage of the first transistor 106 and the second transistor 108 to operating temperature, and the inversely proportional nature of the base-to-emitter voltage of the first transistor 106 and the second transistor 108. The combination of the first transistor 106, the second transistor 108, the amplifier 110, the first resistor 112, the second resistor 114, the third resistor 116, the fourth resistor 118, and the fifth resistor 120 are known as a Brokaw circuit or Brokaw cell.

The compensation controller 104 is configured to provide second-order temperature compensation for the voltage reference circuit 102. For example, the compensation controller 104 is configured to adjust the amount of current flowing through the first current path 122 as a function of operating temperature. The compensation controller 104 illustrated in FIG. 1 includes a low temperature compensation circuit 132 and a high temperature compensation circuit 134. In some implementations, the low temperature compensation circuit 132 and the high temperature compensation circuit 134 each act as voltage-to-current converters as will be described further below in relation to FIGS. 4 and 5. In some implementations, the low temperature compensation circuit 132 and the high temperature compensation circuit 134 are positioned within a single component (as illustrated in FIG. 1). In alternate implementations, the low temperature compensation circuit 132 and the high temperature compensation circuit 134 may be positioned within separate components.

The low temperature compensation circuit 132 is configured to extract a compensation current (an example of a "first compensation current") from the first current path 122 at low operating temperatures as will be described further below in relation to FIG. 4. The low temperature compensation circuit 132 illustrated in FIG. 1 includes reference inputs 136, 138, and 140, and a compensation output 142. Reference input 136 is coupled to the second node 130. Reference input 138 is coupled to a medial mode between the fourth resistor 118 and the fifth resistor 120 as illustrated in FIG. 1. Reference input 140 is coupled to the amplifier 110 to receive a control signal therefrom. In some implementations, the low temperature compensation circuit 132 is also coupled to the amplifier 110 to receive the reference voltage VREF therefrom (not shown). Compensation output 142 is coupled to the first node 128. The high temperature compensation circuit 134 is configured to extract a compensation current (an example of a "first compensation current") from the first current path 122 at high operating temperatures as will be described further below in relation to FIG. 5. The high temperature compensation circuit 134 illustrated in FIG. 1 includes reference inputs 144, 146, and 148, and a compensation output 150. Reference input 144 is coupled to the second node 130. Reference input 146 is coupled to a medial mode between the third resistor 116 and the fourth resistor 118 as illustrated in FIG. 1. Reference input 148 is coupled to the amplifier 110 to receive a control signal therefrom. In some implementations, the high temperature compensation circuit 134 is also coupled to the amplifier 110 to receive the reference voltage VREF therefrom (not shown). Compensation output 150 is coupled to the first node 128.

Figure 2A:
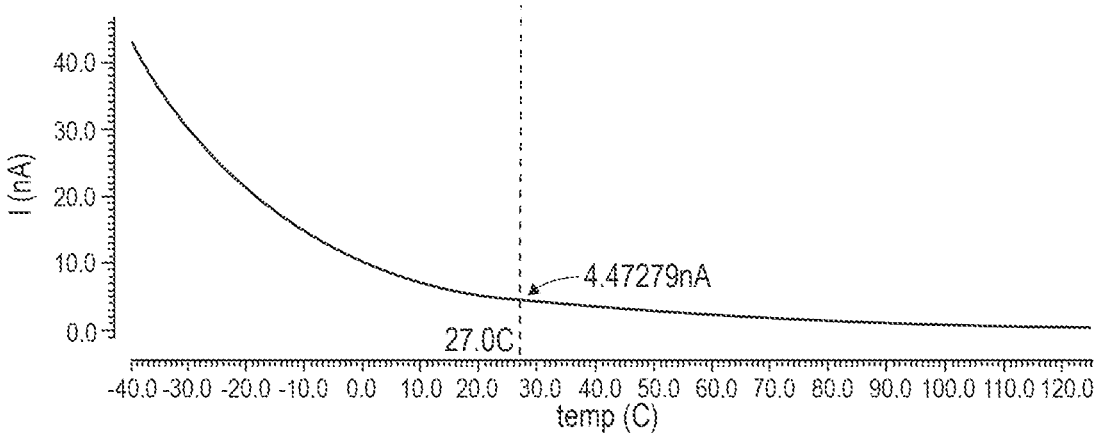
FIG. 2A is a plot of an example of compensation currents extracted at different operating temperatures.
Figure 2B:
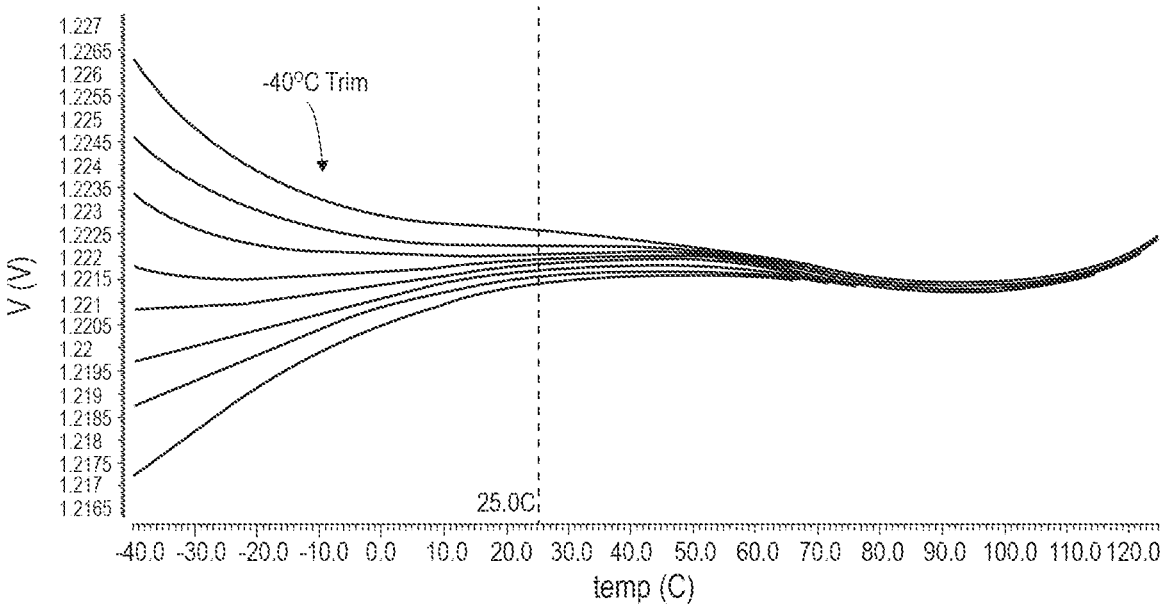
FIG. 2B is a plot of example of reference voltages produced at different operating temperatures.
Figure 3A:
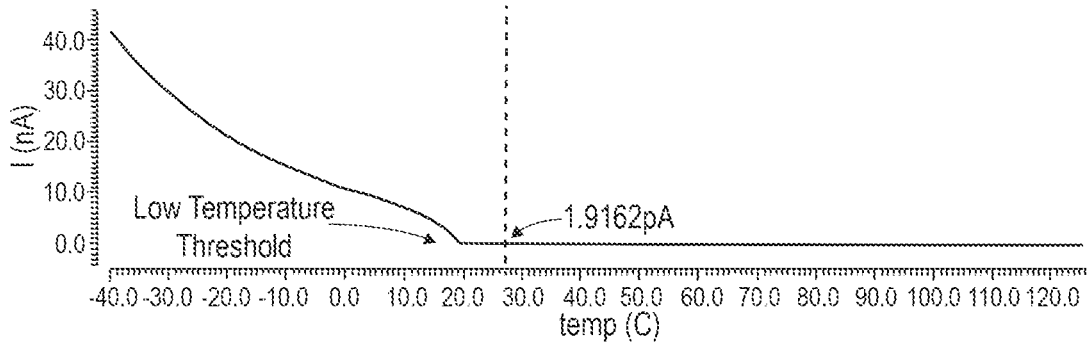
FIG. 3A is a plot of an example of compensation currents extracted by a low temperature compensation circuit included in the system of FIG. 1 in accordance with some implementations.
Figure 3B:
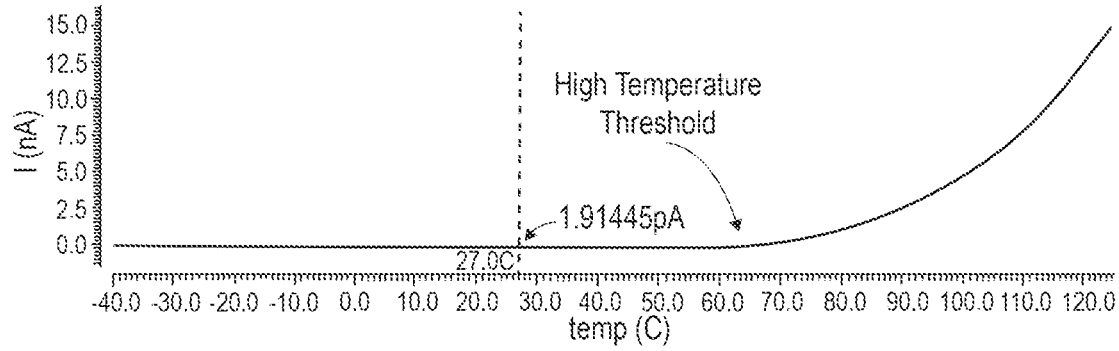
FIG. 3B is a plot an example of compensation currents extracted by a high temperature compensation circuit included in the system of FIG. 1 in accordance with some implementations.
Figure 3C:
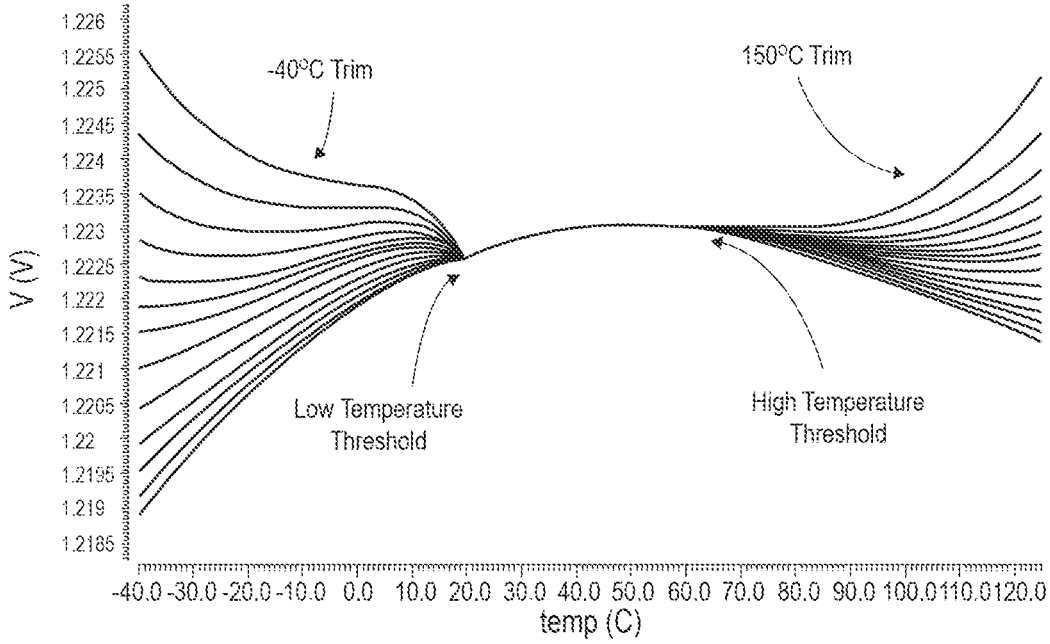
FIG. 3C is a plot of examples of reference voltages produced at different operating temperatures by the system of FIG. 1 in accordance with some implementations.

If always active, the low temperature compensation circuit 132 and the high temperature compensation circuit 134 would extract compensation currents at room temperature (e.g., about 27° C.). For example, the plot in FIG. 2A illustrates that the compensation current extracted by the low temperature compensation circuit 132 at room temperature would not be zero. Thus, when the second-order temperature compensation is trimmed to change the −40° C. value of the reference voltage VREF, the 27° C. value of the reference voltage VREF is also changed as illustrated by the plot in FIG. 2B. To prevent the correction at −40° C. from affecting the correction at 27° C., the compensation controller 104 deactivates the low temperature compensation circuit 132 when the operating temperature is greater than a low temperature threshold. For example, the compensation controller 104 may deactivate the low temperature compensation circuit 132 when the operating temperature is greater than 18° C. as illustrated by the plot in FIG. 3A. As illustrated in FIG. 3A, the low temperature compensation circuit 132 does not extract any compensation current when the operating temperature is greater than the low temperature threshold. The low temperature threshold (an example of a "first temperature threshold") is less than 27° C. For example, in some implementations, the low temperature threshold is set between 10° C. and 20° C. Similarly, to prevent the correction at 150° C. from affecting the correction at 27° C., the compensation controller 104 is configured to deactivate the high temperature compensation circuit 134 when the operating temperature is less than a high temperature threshold. For example, the compensation controller 104 may deactivate the high temperature compensation circuit 134 when the operating temperature is less than 62° C. as illustrated by the plot in FIG. 3B. As illustrated in FIG. 3B, the high temperature compensation circuit 134 does not extract any compensation current when the operating temperature is less than the high temperature threshold. The high temperature threshold (an example of a "second temperature threshold") is set to be greater than 27° C. For example, in some implementations, the high temperature threshold is set between 60° C. and 70° C. FIG. 3C is a plot of examples of voltage references produced by the system 100 with different −40° C. and 150° C. trim values. As illustrated in FIG. 3C, the voltage reference VREF values produced between the low temperature threshold and the high temperature threshold are unchanged. By deactivating the low temperature compensation circuit 132 and the high temperature compensation circuit 134 at normal operating temperatures, the system 100 can achieve a theoretical accuracy of about +/−0.04%.

Figure 4:
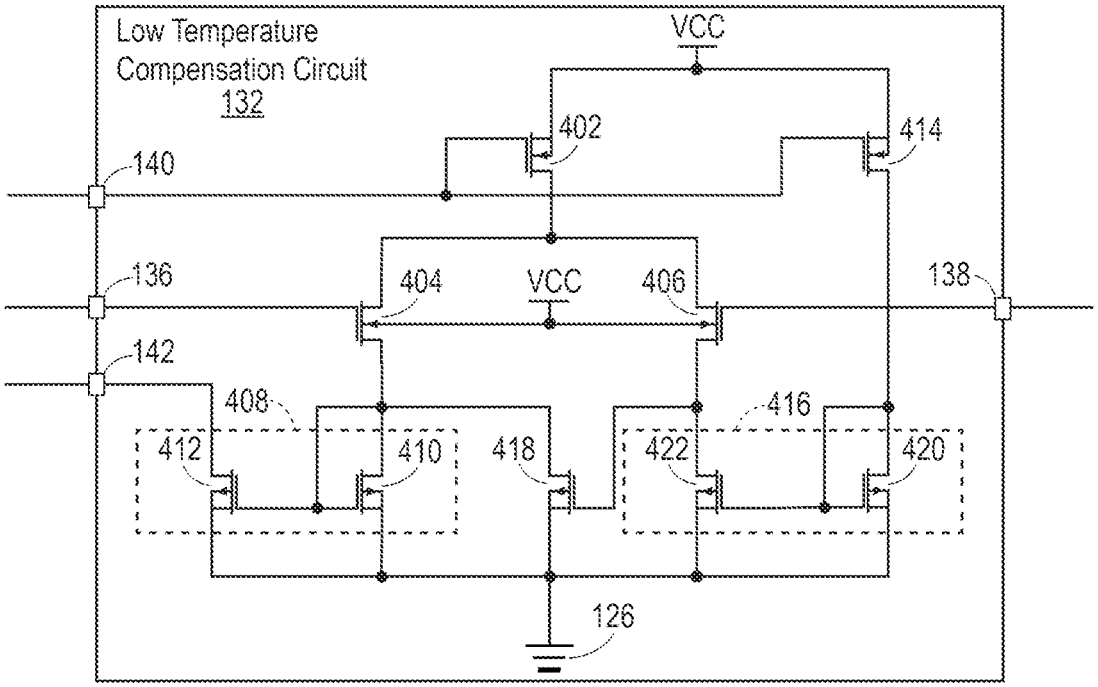
FIG. 4 is a schematic diagram of an example of a low temperature compensation circuit included in the system of FIG. 1 in accordance with some implementations.

FIG. 4 is a schematic diagram of an example of the low temperature compensation circuit 132 in accordance with some implementations. To provide second-order temperature compensation at low operating temperatures, the low temperature compensation circuit 132 illustrated in FIG. 4 includes transistors 402, 404, and 406, and a first current mirror 408. In some implementations, the source of transistor 402 is coupled to the voltage source VCC (as illustrated in FIG. 4). In alternative implementations, the source of transistor 402 is coupled to the output of the amplifier 110 to receive the reference voltage VREF therefrom. The gate of transistor 402 is coupled to reference input 140. As described above and illustrated in FIG. 1, reference input 140 is coupled to the amplifier 110 to receive a control signal therefrom. The drain of transistor 402 is coupled the sources of transistors 404 and 406. In some implementations, the size (or area) of transistor 402 is approximately 1.2 micrometers. The gate of transistor 404 (an example of a "third transistor") is coupled to the second node 130 via reference input 136. The gate of transistor 406 is coupled to the output of the amplifier 110 via reference input 138, the fourth resistor 118, and the third resistor 116 (as illustrated in FIG. 1). In some implementations, the bodies of transistors 404 and 406 are coupled to the voltage source VCC (as illustrated in FIG. 4). In alternative implementations, the bodies of transistors 404 and 406 are coupled to the output of the amplifier 110 to receive the reference voltage VREF therefrom. The first current mirror 408 illustrated in FIG. 4 is formed by a primary transistor 410 and a mirror transistor 412. The drain of primary transistor 410 is coupled to the drain of transistor 404. The drain of mirror transistor 412 is coupled to the first current path 122 via compensation output 142. The sources of primary transistor 410 and mirror transistor 412 are coupled to the reference terminal 126. The gates of primary transistor 410 and mirror transistor 412 are coupled together, and are further coupled to the drain of transistor 404. The drain-to-source voltage of primary transistor 410 defines a reference current path of first current mirror 408. The drain-to-source voltage of mirror transistor 412 defines a mirror current path of first current mirror 408. In operation, the first current mirror 408 senses a current flow along its reference current path, and attempts to create a mirror current along its mirror current path based on current flow in its reference current path. Because the drain of mirror transistor 412 is coupled to first current path 122, the first current mirror 408 extracts a compensation current from the first current path 122. As the operating temperature increases, e.g., from −40° C., the current flowing through transistor 404 (an example of a "control current") decreases which causes the current flowing through primary transistor 410 to also decrease. Because of the first current mirror 408, the current flowing through mirror transistor 412 also decreases as the operating temperature increases, and thus, the amount of compensation current extracted from the first current path 122 by the low temperature compensation circuit 132 decreases as the operating temperature increases.

To deactivate the low temperature compensation circuit 132, the low temperature compensation circuit 132 illustrated in FIG. 4 includes transistor 414, a second current mirror 416, and transistor 418. In some implementations, the source of transistor 414 is coupled to the voltage source VCC (as illustrated in FIG. 4). In alternative implementations, the source of transistor 414 is coupled to the output of the amplifier 110 to receive the reference voltage VREF therefrom. The gate of transistor 414 is coupled to reference input 140. As described above and illustrated in FIG. 1, reference input 140 is coupled to the amplifier 110 to receive a control signal therefrom. In some implementations, the size (or area) of transistor 414 is same as transistor 402 (e.g., approximately 1.2 micrometers). The second current mirror 416 illustrated in FIG. 4 is formed by a primary transistor 420 and a mirror transistor 422. The drain of primary transistor 420 is coupled to the drain of transistor 414. The drain of mirror transistor 422 is coupled to the drain of transistor 406. The sources of primary transistor 420 and mirror transistor 422 are coupled to the reference terminal 126. The gates of primary transistor 420 and mirror transistor 422 are coupled together, and are further coupled to the drain of transistor 414. The drain-to-source voltage of primary transistor 420 defines a reference current path of the second current mirror 416. The drain-to-source voltage of mirror transistor 422 defines a mirror current path of the second current mirror 416. In operation, the second current mirror 416 senses a current flow along its reference current path, and attempts to create a mirror current along its mirror current path based on current flow in its reference current path. The drain of transistor 418 is coupled to the drain of transistor 404, the drain of primary transistor 410, and the gates of primary transistor 410 and mirror transistor 412. The source of transistor 418 is coupled to the reference terminal 126. The gate of transistor 418 is coupled to the drains of transistor 406 and mirror transistor 422. When the operating temperature is less than or equal to the low temperature threshold, the majority of the current flowing through transistor 406 also flows through mirror transistor 422 (i.e., to copy the current flowing through primary transistor 420 from transistor 414). When the majority of the current flowing through transistor 406 (an example of a "fourth transistor") also flows through mirror transistor 422 (an example of a "fifth transistor"), transistor 418 (an example of a "sixth transistor") is inactive because the voltage applied to the gate of transistor 418 is below an activation threshold. When transistor 418 is inactive, all the current flowing through transistor 404 also flows through primary transistor 410. Thus, mirror transistor 412 extracts a compensation current from the first current path 122 when transistor 418 is inactive. As the operating temperature increases, e.g., from −40° C., the current flowing through transistor 406 increases. When the current flowing through transistor 406 crosses the current capability of mirror transistor 422, the gate voltage of transistor 418 rises until transistor 418 activates. The current flowing through transistor 418 (i.e., from its drain to its source) is subtracted from the current provided by transistor 404 (an example of a "control current"), forcing to zero the current flowing through primary transistor 410 and mirror transistor 412. The current flowing through mirror transistor 412 is so kept to zero from the low temperature threshold up to higher temperatures. Thus, mirror transistor 412 does not extract a compensation current from the first current path 122 when transistor 418 is active. In this manner, the low temperature compensation circuit 132 is active when the operating is less than or equal to the low temperature threshold and inactive when the operating temperature is greater than the low temperature threshold.

The first current mirror 408 and the second current mirror 416 illustrated in FIG. 4 are merely illustrative, and other mirror types (e.g., cascade, Wilson, Widlar current mirror) may be used. Any suitable current mirror may be used, including programmable current mirrors with mirror ratios that are controlled by a controller and/or analog-to-digital converter. Transistors 402, 404, 406, and 414 are illustrated in FIG. 4 as P-Channel metal-oxide-semiconductor FETs (MOSFETs). Further, primary transistor 410, mirror transistor 412, transistor 418, primary transistor 420, and mirror transistor 422 are illustrated in FIG. 4 as N-Channel MOSFETs. However, other types of FETs may be used (e.g., insulated-gate FETs), and in fact other types of transistors may also be used (e.g., BJTs).

Figure 5:
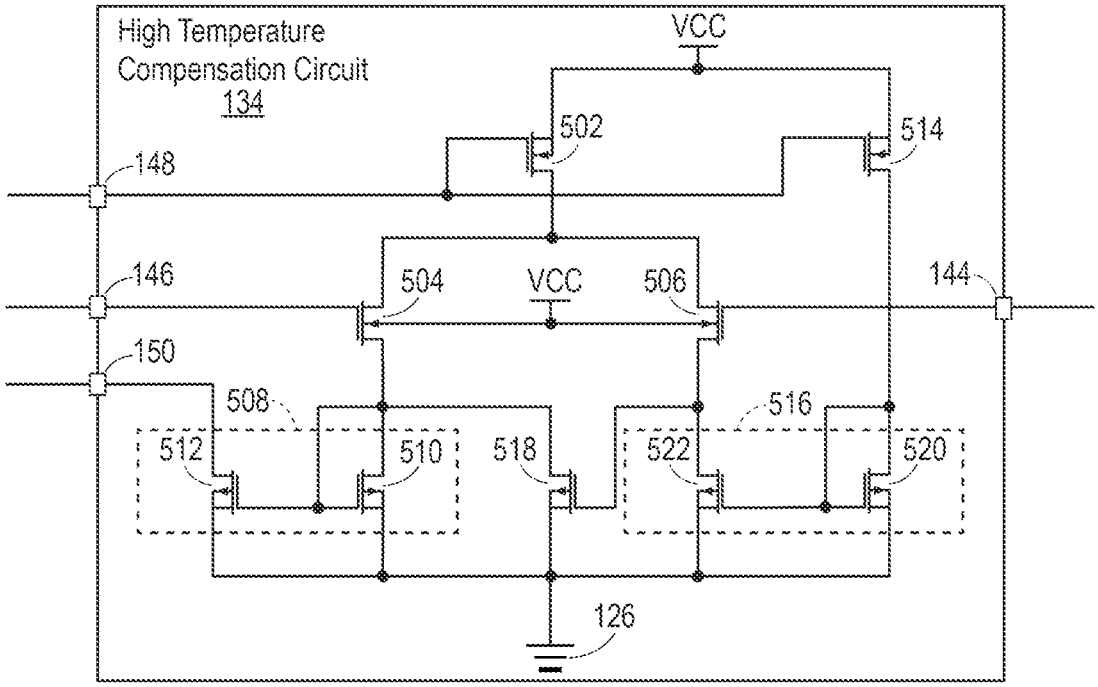
FIG. 5 is a schematic diagram of an example of a high temperature compensation circuit included in the system of FIG. 1 in accordance with some implementations.

FIG. 5 is a schematic diagram of an example of the high temperature compensation circuit 134 in accordance with some implementations. To provide second-order temperature compensation at high operating temperatures, the high temperature compensation circuit 134 illustrated in FIG. 5 includes transistors 502, 504, and 506, and a third current mirror 508. In some implementations, the source of transistor 502 is coupled to the voltage source VCC (as illustrated in FIG. 5). In alternative implementations, the source of transistor 502 is coupled to the output of the amplifier 110 to receive the reference voltage VREF therefrom. The gate of transistor 502 is coupled to reference input 148. As described above and illustrated in FIG. 1, reference input 148 is coupled to the amplifier 110 to receive a control signal therefrom. The drain of transistor 502 is coupled the sources of transistors 504 and 506. In some implementations, the size (or area) of transistor 502 is approximately 0.6 micrometers. The gate of transistor 504 is coupled to the output of the amplifier 110 via reference input 146 and the third resistor 116 (as illustrated in FIG. 1). The gate of transistor 506 is coupled to the second node 130 via reference input 144. In some implementations, the bodies of transistors 504 and 506 are coupled to the voltage source VCC (as illustrated in FIG. 5). In alternative implementations, the bodies of transistors 504 and 506 are coupled to the output of the amplifier 110 to receive the reference voltage VREF therefrom. The third current mirror 508 illustrated in FIG. 5 is formed by a primary transistor 510 and a mirror transistor 512. The drain of primary transistor 510 is coupled to the drain of transistor 504. The drain of mirror transistor 512 is coupled to the first current path 122 via compensation output 150. The sources of primary transistor 510 and mirror transistor 512 are coupled to the reference terminal 126. The gates of primary transistor 510 and mirror transistor 512 are coupled together, and are further coupled to the drain of transistor 504. The drain-to-source voltage of primary transistor 510 defines a reference current path of the third current mirror 508. The drain-to-source voltage of mirror transistor 512 defines a mirror current path of the third current mirror 508. In operation, the third current mirror 508 senses a current flow along its reference current path, and attempts to create a mirror current along its mirror current path based on current flow in its reference current path. Because the drain of mirror transistor 512 is coupled to the first current path 122, the third current mirror 508 extracts a compensation current from the first current path 122. As the operating temperature decreases, e.g., from 150° C., the current flowing through transistor 504 (an example of a "control current") decreases which causes the current flowing through primary transistor 510 to also decrease. Because of the third current mirror 508, the current flowing through mirror transistor 512 also decreases as the operating temperature decreases, and thus, the amount of compensation current extracted from the first current path 122 by the high temperature compensation circuit 134 decreases as the operating temperature decreases.

To deactivate the high temperature compensation circuit 134, the high temperature compensation circuit 134 illustrated in FIG. 5 includes transistor 514, fourth current mirror 516, and transistor 518. In some implementations, the source of transistor 514 is coupled to the voltage source VCC (as illustrated in FIG. 5). In alternative implementations, the source of transistor 514 is coupled to the output of the amplifier 110 to receive the reference voltage VREF therefrom. The gate of transistor 514 is coupled to reference input 148. As described above and illustrated in FIG. 1, reference input 148 is coupled to the amplifier 110 to receive a control signal therefrom. In some implementations, the size (or area) of transistor 514 is same as transistor 502 (e.g., approximately 0.6 micrometers). The fourth current mirror 516 illustrated in FIG. 5 is formed by a primary transistor 520 and a mirror transistor 522. The drain of primary transistor 520 is coupled to the drain of transistor 514. The drain of mirror transistor 522 is coupled to the drain of transistor 506. The sources of primary transistor 520 and mirror transistor 522 are coupled to the reference terminal 126. The gates of primary transistor 520 and mirror transistor 522 are coupled together, and are further coupled to the drain of transistor 514. The drain-to-source voltage of primary transistor 520 defines a reference current path of the fourth current mirror 516. The drain-to-source voltage of mirror transistor 522 defines a mirror current path of the fourth current mirror 516. In operation, the fourth current mirror 516 senses a current flow along its reference current path, and attempts to create a mirror current along its mirror current path based on current flow in its reference current path. The drain of transistor 518 is coupled to the drain of transistor 504, the drain of primary transistor 510, and the gates of primary transistor 510 and mirror transistor 512. The source of transistor 518 is coupled to the reference terminal 126. The gate of transistor 518 is coupled to the drains of transistor 506 and mirror transistor 522. When the operating temperature is greater than or equal to the high temperature threshold, the majority of the current flowing through transistor 506 also flows through mirror transistor 522 (i.e., to copy the current flowing through primary transistor 520 from transistor 514). When the majority of the current flowing through transistor 506 also flows through mirror transistor 522, transistor 518 is inactive because the voltage applied the gate of transistor 518 is below an activation threshold. When transistor 518 is inactive, all the current flowing through transistor 504 also flows through primary transistor 510. Thus, mirror transistor 512 extracts a compensation current from the first current path 122 when transistor 518 is inactive. As the operating temperature decreases, e.g., from 150° C., the current flowing through transistor 506 increases. When the current flowing through transistor 506 crosses the current capability of mirror transistor 522, the gate voltage of transistor 518 rises until transistor 518 activates. The current flowing through transistor 518 (i.e., from its drain to its source) is subtracted from the current provided by transistor 504 (an example of a "control current"), forcing to zero the current flowing through primary transistor 510 and mirror transistor 512. The current flowing through mirror transistor 512 is so kept to zero from the high temperature threshold down to lower temperatures. Thus, mirror transistor 512 does not extract a compensation current from the first current path 122 when transistor 518 is active. In this manner, the high temperature compensation circuit 134 is active when the operating is greater than or equal to the high temperature threshold and inactive when the operating temperature is less than the high temperature threshold.

The third current mirror 508 and the fourth current mirror 516 illustrated in FIG. 5 are merely illustrative, and other mirror types (e.g., cascade, Wilson, Widlar current mirror) may be used. Any suitable current mirror may be used, including programmable current mirrors with mirror ratios that are controlled by a controller and/or analog-to-digital converter. Transistors 502, 504, 506, and 514 are illustrated in FIG. 5 as P-Channel MOSFETs. Further, primary transistor 510, mirror transistor 512, transistor 518, primary transistor 520, and mirror transistor 522 are illustrated in FIG. 5 as N-Channel MOSFETs. However, other types of FETs may be used (e.g., insulated-gate FETs), and in fact other types of transistors may also be used (e.g., BJTs).

Figure 6:
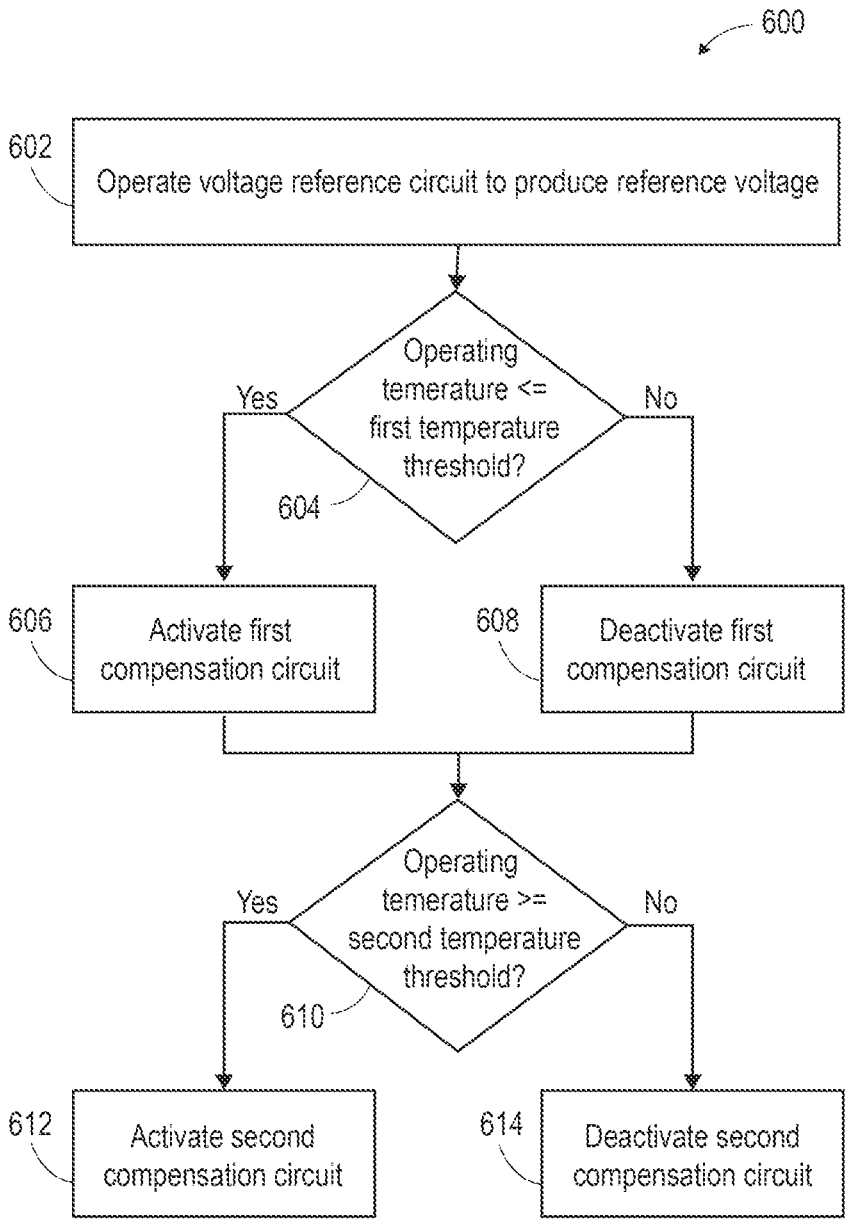
FIG. 6 is a flow diagram of an example of a method for producing a compensated voltage reference in accordance with some implementations.

FIG. 6 is a flow diagram of an example of a method for producing a compensated voltage reference. At block 602, a voltage reference circuit operates to produce a reference voltage. For example, the voltage reference circuit 102 operates to produce the reference voltage VREF. At block 604, it is determined if the operating temperature is less than or equal to a first temperature threshold (e.g., a low temperature threshold). When the operating temperature is less than or equal to the first temperature threshold, a first compensation circuit is activated (at block 606). For example, the low temperature compensation circuit 132 is activated and the low temperature compensation circuit 132 extracts a compensation current from the voltage reference circuit 102 as previously described above. Alternatively, when the operating temperature is greater than the first temperature threshold, the first compensation circuit is deactivated (at block 608). For example, the low temperature compensation circuit 132 is deactivated and the low temperature compensation circuit 132 does not extract a compensation current from the voltage reference circuit 102. Next, at block 610, it is determined if the operating temperature is greater than or equal to a second temperature threshold (e.g., a high temperature threshold. The second temperature threshold is greater than the first temperature threshold. When the operating temperature is greater than or equal to the second temperature threshold, a second compensation circuit is activated (at block 612). For example, the high temperature compensation circuit 134 is activated and the high temperature compensation circuit 134 extracts a compensation current from the voltage reference circuit 102 as previously described above. Alternatively, when the operating temperature is less than the second temperature threshold, the second compensation circuit is deactivated (at block 614). For example, the high temperature compensation circuit 134 is deactivated and the high temperature compensation circuit 134 does not extract a compensation current from the voltage reference circuit 102. In some implementations, the method 600 ends after block 612 or block 614. In alternative implementations, the method 600 returns to block 604 after block 612 or block 614. Although illustrated in FIG. 6 as a sequence, all or any portions of the method may be executed simultaneously. For example, blocks 604 and 610 may execute at the same time.

The present disclosure also provides an apparatus for producing a compensated voltage reference. The apparatus includes means for driving a first reference current through a first current path. The means for driving the first reference current through the first current path may refer, e.g., to the voltage reference circuit 102 as a whole or one or more components of the voltage reference circuit 102 (e.g., the first transistor 106). The apparatus also includes means for driving a second reference current through a second current path. The means for driving the second reference current through the second current path may refer, e.g., to the voltage reference circuit 102 as a whole or one or more components of the voltage reference circuit 102 (e.g., the second transistor 108). The apparatus further includes means for producing a reference voltage based on a difference between currents present on the first current path and the second current path. The means for producing the reference voltage may refer, e.g., to the voltage reference circuit 102 as a whole or one or more components of the voltage reference circuit 102 (e.g., amplifier 110). The apparatus also includes means for extracting a first compensation current from the first current path. The means for extracting the first compensation current may refer, e.g., to the compensation controller 104 as a whole, a component of the compensation controller 104 (e.g., the low temperature compensation circuit 132 as a whole), or one or more components of the low temperature compensation circuit 132 (e.g., transistor 402, transistor 404, transistor 406, the first current mirror 408, primary transistor 410, mirror transistor 412, or a combination thereof). The apparatus further includes means for extracting a second compensation current from the first current path. The means for extracting the second compensation current may refer, e.g., to the compensation controller 104 as a whole, a component of the compensation controller 104 (e.g., the high temperature compensation circuit 134 as a whole), or one or more components of the high temperature compensation circuit 134 (e.g., transistor 502, transistor 504, transistor 506, the third current mirror 508, primary transistor 510, mirror transistor 512, or a combination thereof). The apparatus also includes means for activating the means for extracting the first compensation current when an operating temperature is less than or equal to a first temperature threshold. The means for activating the means for extracting the first compensation current may refer, e.g., to the compensation controller 104 as a whole, a component of the compensation controller 104 (e.g., the low temperature compensation circuit 132 as a whole), or one or more components of the low temperature compensation circuit 132 (e.g., transistor 414, the second current mirror 416, transistor 418, primary transistor 420, mirror transistor 422, or a combination thereof). The apparatus further includes means for deactivating the means for extracting the first compensation current when the operating temperature is greater than the first temperature threshold. The means for deactivating the means for extracting the first compensation current may refer, e.g., to the compensation controller 104 as a whole, a component of the compensation controller 104 (e.g., the low temperature compensation circuit 132 as a whole), or one or more components of the low temperature compensation circuit 132 (e.g., transistor 414, the second current mirror 416, transistor 418, primary transistor 420, mirror transistor 422, or a combination thereof). The apparatus also includes means for activating the means for extracting the second compensation current when the operating temperature is greater than or equal to a second temperature threshold. The means for activating the means for extracting the second compensation current may refer, e.g., to the compensation controller 104 as a whole, a component of the compensation controller 104 (e.g., the high temperature compensation circuit 134 as a whole), or one or more components of the high temperature compensation circuit 134 (e.g., transistor 514, the fourth current mirror 516, transistor 518, primary transistor 520, mirror transistor 522, or a combination thereof). The second temperature threshold is greater than the first temperature threshold. The apparatus further includes means for deactivating the means for extracting the second compensation current when the operating temperature is less than the second temperature threshold. The means for deactivating the means for extracting the second compensation current may refer, e.g., to the compensation controller 104 as a whole, a component of the compensation controller 104 (e.g., the high temperature compensation circuit 134 as a whole), or one or more components of the high temperature compensation circuit 134 (e.g., transistor 514, the fourth current mirror 516, transistor 518, primary transistor 520, mirror transistor 522, or a combination thereof). In some implementations, the apparatus also includes means for extracting a third compensation current from the first current path when the operating temperature is greater than the first temperature threshold and less than the second temperature threshold. The means for extracting the third compensation current may refer, e.g., to the voltage reference circuit 102 as a whole or one or more components of the voltage reference circuit 102 (e.g., first resistor 112, second resistor 114, third resistor 116, fourth resistor 118, fifth resistor 120, or a combination thereof).

Many of the electrical connections in the drawings are shown as direct couplings having no intervening devices, but not expressly stated as such in the description above. Nevertheless, this paragraph shall serve as antecedent basis in the claims for referencing any electrical connection as "directly coupled" for electrical connections shown in the drawing with no intervening device(s).

The above discussion is meant to be illustrative of the principles and various implementations of the present invention. Numerous variations and modifications will become apparent to those skilled in the art once the above disclosure is fully appreciated. It is intended that the following claims be interpreted to embrace all such variations and modifications.

What is claimed is:

1. A method for producing a compensated voltage reference, the method comprising:

operating a voltage reference circuit comprising a first transistor configured to drive a first reference current through a first current path, a second transistor configured to drive a second reference current through a second current path, and an amplifier configured to produce a reference voltage based on a difference between currents present on the first current path and the second current path;

activating a first compensation circuit when an operating temperature is less than or equal to a first temperature threshold, wherein the first compensation circuit is configured to extract a first compensation current from the first current path;

deactivating the first compensation circuit when the operating temperature is greater than the first temperature threshold;

activating a second compensation circuit when the operating temperature is greater than or equal to a second temperature threshold, wherein the second compensation circuit is configured to extract a second compensation current from the first current path, wherein the second temperature threshold is greater than the first temperature threshold; and deactivating the second compensation circuit when the operating temperature is less than the second temperature threshold.

2. The method of claim 1, wherein a magnitude of the first compensation current is proportional to the operating temperature, and wherein a magnitude of the second compensation current is proportional to the operating temperature.

3. The method of claim 1, wherein the first temperature threshold is less than 27 degrees Celsius, and wherein the second temperature threshold is greater than 27 degrees Celsius.

4. The method of claim 3, wherein the first temperature threshold is between 10 degrees Celsius and 20 degrees Celsius, and wherein the second temperature threshold is between 60 degrees Celsius and 70 degrees Celsius.

5. The method of claim 1, wherein deactivating the first compensation circuit further includes extracting a control current from a reference current path of a current mirror included in the first compensation circuit.

6. The method of claim 1, further comprising:

extracting a third compensation current from the first current path when the operating temperature is greater than the first temperature threshold and less than the second temperature threshold.

7. A system for producing a compensated voltage reference, comprising:

a voltage reference circuit including:

a first transistor configured to drive a first reference current through a first current path, a second transistor configured to drive a second reference current through a second current path, and an amplifier having a non-inverting input coupled to the first current path and an inverting input coupled to the second current path, wherein the amplifier is configured to produce a reference voltage based on a difference between currents present on the first current path and the second current path; and a compensation controller including:

a first compensation circuit configured to extract a first compensation current from the first current path, and a second compensation circuit configured to extract a second compensation current from the first current path, wherein the compensation controller is configured to:

activate the first compensation circuit when an operating temperature is less than or equal to a first temperature threshold, deactivate the first compensation circuit when the operating temperature is greater than the first temperature threshold, activate the second compensation circuit when the operating temperature is greater than or equal to a second temperature threshold, wherein the second temperature threshold is greater than the first temperature threshold, and deactivate the second compensation circuit when the operating temperature is less than the second temperature threshold.

8. The system of claim 7, wherein a magnitude of the first compensation current is proportional to the operating temperature, and wherein a magnitude of the second compensation current is proportional to the operating temperature.

9. The system of claim 7, wherein the first temperature threshold is less than 27 degrees Celsius, and wherein the second temperature threshold is greater than 27 degrees Celsius.

10. The system of claim 7, wherein the first compensation circuit includes a current mirror, and wherein, to deactivate the first compensation circuit, the compensation controller is further configured to extract a control current from a reference current path of the current mirror.

11. The system of claim 10, wherein the first compensation circuit further includes:

a current mirror defining a reference current path and a mirror current path, wherein the current mirror is configured to extract the first compensation current from the first current path through mirror current path, a third transistor configured to supply current to the reference current path, wherein the current supplied by the third transistor is inversely related to the operating temperature, a fourth transistor configured to supply current, wherein the current supplied by the fourth transistor is inversely related to the current supplied by the third transistor, a fifth transistor configured to receive the current supplied by the fourth transistor, and a sixth transistor configured to activate when current supplied by the fourth transistor is greater than a current capacity of the fifth transistor, wherein, when active, the sixth transistor is configured to extract substantially all the current supplied by the third transistor to the reference current path.

12. The system of claim 7, wherein a collector of the first transistor is coupled to the non-inverting input of the amplifier, wherein a collector of the second transistor is coupled to the inverting input of the amplifier, wherein an output of the amplifier is coupled to a base of the first transistor and a base of the second transistor, wherein the voltage reference circuit further includes:

a first resistor coupled between an emitter of the first transistor and an emitter of the second transistor, and a second resistor coupled between the emitter of the second transistor and a reference terminal.

13. The system of claim 7, wherein the compensation controller is further configured to extract a third compensation current from the first current path when the operating temperature is greater than the first temperature threshold and less than the second temperature threshold.

14. The system of claim 7, wherein the first compensation circuit does not extract the first compensation current from the first current path when the operating temperature is greater than the first temperature threshold.

15. An apparatus for producing a compensated voltage reference, comprising:

means for driving a first reference current through a first current path;

means for driving a second reference current through a second current path;

means for producing a reference voltage based on a difference between currents present on the first current path and the second current path;

means for extracting a first compensation current from the first current path;

means for extracting a second compensation current from the first current path;

means for activating the means for extracting the first compensation current when an operating temperature is less than or equal to a first temperature threshold;

means for deactivating the means for extracting the first compensation current when the operating temperature is greater than the first temperature threshold;

means for activating the means for extracting the second compensation current when the operating temperature is greater than or equal to a second temperature threshold, wherein the second temperature threshold is greater than the first temperature threshold; and means for deactivating the means for extracting the second compensation current when the operating temperature is less than the second temperature threshold.

16. The apparatus of claim 15, wherein a magnitude of the first compensation current is proportional to the operating temperature, and wherein a magnitude of the second compensation current is proportional to the operating temperature.

17. The apparatus of claim 15, wherein the first temperature threshold is less than 27 degrees Celsius, and wherein the second temperature threshold is greater than 27 degrees Celsius.

18. The apparatus of claim 17, wherein the first temperature threshold is between 10 degrees Celsius and 20 degrees Celsius, and wherein the second temperature threshold is between 60 degrees Celsius and 70 degrees Celsius.

19. The apparatus of claim 15, wherein the means for deactivating the means for extracting the first compensation current is further configured to extract a control current from a reference current path of a current mirror included in the means for extracting the first compensation current.

20. The apparatus of claim 15, further comprising means for extracting a third compensation current from the first current path when the operating temperature is greater than the first temperature threshold and less than the second temperature threshold.

* * * * *